US008177883B2

(12) United States Patent
Jørgensen et al.

(10) Patent No.: US 8,177,883 B2
(45) Date of Patent: May 15, 2012

(54) CONTAINER WITH CONTROLLED ATMOSPHERE

(75) Inventors: Gert Jørgensen, Gråsten (DK); Niels Nielsen Poulsen, Vojens (DK)

(73) Assignee: Maersk Container Industri A/S, Tinglev (DK)

( * ) Notice: Subject to any disclaimer, the term of this patent is extended or adjusted under 35 U.S.C. 154(b) by 206 days.

(21) Appl. No.: 12/371,089

(22) Filed: Feb. 13, 2009

(65) Prior Publication Data

US 2009/0185948 A1 Jul. 23, 2009

Related U.S. Application Data

(63) Continuation-in-part of application No. 11/864,591, filed on Sep. 28, 2007, now abandoned, which is a continuation of application No. PCT/DK2007/000369, filed on Aug. 9, 2007, and a continuation-in-part of application No. 11/501,647, filed on Aug. 9, 2006, now abandoned.

(51) Int. Cl.

| | |
|---|---|
| ***B01D 53/22*** | (2006.01) |
| ***B01D 53/30*** | (2006.01) |
| ***A23B 7/144*** | (2006.01) |
| ***A23B 7/148*** | (2006.01) |
| ***A23L 3/3418*** | (2006.01) |
| ***B65D 81/20*** | (2006.01) |

(52) U.S. Cl. ..... 95/12; 95/8; 95/45; 95/51; 95/54; 96/4; 96/11; 96/397; 96/417; 55/385.1; 55/385.4; 426/418; 426/419; 99/468; 422/3; 422/4

(58) Field of Classification Search ..... 96/4, 11, 96/12, 13, 14, 397, 417; 95/8, 12, 45, 51, 95/54; 55/385.1, 385.4, 523, 524, DIG. 5; 210/640, 641, 649, 500.27, 500.28, 500.38, 210/500.43; 156/155; 426/418, 419; 99/468; 418/259; 417/13, 14, 228, 313; 219/201, 219/490, 536; 422/3, 4, 292

See application file for complete search history.

(56) References Cited

U.S. PATENT DOCUMENTS

| | | | | |
|---|---|---|---|---|
| 4,295,804 | A * | 10/1981 | Pezzot | 418/15 |
| 7,601,202 | B2 * | 10/2009 | Noack et al. | 95/51 |
| 7,740,457 | B2 * | 6/2010 | Lehmann | 417/313 |

FOREIGN PATENT DOCUMENTS

| | | |
|---|---|---|
| WO | WO 2004/107868 | 12/2004 |
| WO | WO 2004/107868 A1 * | 12/2004 |

OTHER PUBLICATIONS

Office Action for related U.S. Appl. No. 11/864,591, mailed Feb. 12, 2010.

* cited by examiner

*Primary Examiner* — Jason M Greene
(74) *Attorney, Agent, or Firm* — Brinks Hofer Gilson & Lione

(57) ABSTRACT

A container having a plurality of walls, and at least one inlet and/or outlet, said container including an apparatus for controlling the composition of gases within the container, the apparatus including at least one sensor, at least one controller and at least one gas permeable membrane, through which membrane different gases can pass at different rates, said membrane dividing the container into a first region being for holding cargo and a second region defining a gas buffer region, and said membrane being permeable permitting for nitrogen, oxygen and carbon dioxide at different flow rates, wherein the buffer region is in communication with the ambient atmosphere through one or more vacuum pump(s).

20 Claims, 3 Drawing Sheets

CONTAINER WITH CONTROLLED ATMOSPHERE

This application is a continuation-in-part of U.S. patent application Ser. No. 11/864,591, entitled "Gas Permeable Membrane" and filed on Sep. 28, 2007 now abandoned, which is hereby incorporated herein by reference in its entirety. U.S. patent application Ser. No. 11/864,591 is a continuation of International Application No. PCT/DK2007/000369, entitled "A Gas Permeable Membrane" and filed on Aug. 9, 2007, which is hereby incorporated herein by reference in its entirety. U.S. patent application Ser. No. 11/864,591 is also a continuation-in-part of U.S. patent application Ser. No. 11/501,647, entitled "A Gas Permeable Membrane" and filed on Aug. 9, 2006 now abandoned, which is hereby incorporated herein by reference in its entirety.

BACKGROUND

1. Technical Field

The disclosed embodiments relate generally to shipping or transportation containers, specifically containers with a gas permeable membrane for the transport of products and commodities over long distances.

2. Description of Related Art

The use of shipping or transportation containers is known for the transport of products and commodities over long distances. To extend or otherwise preserve the shelf life of such transportable products the shipping containers are normally equipped with some form of temperature regulation system, such as a refrigeration system.

The combined proportions of carbon dioxide and oxygen in ambient atmospheric air are about 21%. However, such a ratio or composition of carbon dioxide and oxygen often does not suit or provide an optimal environment for enhancing the shelf life for many stored products.

Where the products to be transported are perishable goods, such as fruit and/or vegetables, transport containers may also incorporate a system adapted to modify the composition of the refrigerated air surrounding the stored contents. As fresh fruit and vegetables represent active biological systems the atmosphere of a container will constantly change as gases and moisture are consumed or produced by the metabolic processes (such as respiration) occurring within the biological systems present. Furthermore, the shelf life of a lot of shipped produce is highly dependent on the composition of gases within a container where the optimal gaseous composition of a storage container is highly dependent on the specific produce being stored.

When packed, fruits produce $CO_2$ by using $O_2$ that is present in the package due to respiration. To prevent decay of the fruits, it is required to control the $CO_2$ level, e.g., by controlling the exposure of a permeable package wall (=membrane) towards the atmosphere, which contains hardly any $CO_2$.

The basic idea behind this is that, due to the concentration gradient, $CO_2$ will permeate through a permeable wall towards the air-side, thus lowering the $CO_2$ level. In such systems, membranes having a high $CO_2$ flux are desired.

By incorporating an atmospheric modification or control system into a transport container the respiration rates of the stored produce and the composition of gases present within a container may be regulated, thereby providing an effective means for prolonging the shelf life of the container contents in addition to the refrigeration of the air. In particular, the respiration rates of stored produce may be retarded by controlling the mix and/or partial volumes of oxygen, carbon dioxide and nitrogen within the container.

Because an opposite concentration gradient for $O_2$ exists, $O_2$ will permeate from the air side to the fruit side. To minimise this and thus prevent further production of $CO_2$, membranes having a high $CO_2$ flux and a high $CO_2/O_2$ selectivity are often used.

A common approach used in shipping containers to increase the shelf life of produce stored is to create an "ideal" or optimum storage atmosphere (that is different from that of ambient air) at the beginning of the storage period and to maintain that atmosphere. In some cases containers are initially flushed to remove or add gases resulting in an internal gas composition around the stored produce that is different from that of ambient air.

Once the oxygen content of the gases within a container drops further as a result of respiration, inlets may be opened to allow fresh air into the container, thereby delivering oxygen into the container. Such systems often rely on the use of membranes or films which are adapted to prevent the movement of gases into or out of the container, and such systems are commonly referred to as Modified Atmosphere (MA) systems.

However, by ventilating the container with fresh air and letting out the container air, the composition of the gas in the container will over time eventually result in a gas composition in which the carbon dioxide and oxygen content (as a sum proportion of container gases) approaches approximately 21%. Such a proportion of carbon dioxide and oxygen is not necessarily an optimal environment for the storage of certain products. If the container is not initially flushed, the sum of oxygen and carbon dioxide will always remain approximately 21%.

Although such systems may be relatively inexpensive to integrate into a container they are not well suited to adequately control and maintain optimum levels of carbon dioxide within a container, where such optimum levels often differ from those levels of carbon dioxide present in ambient air.

Moreover, the sum proportion of carbon dioxide and oxygen in a container will always remain approximately 21% unless the composition of either the outgoing and/or ingoing air is actively and effectively manipulated to thereby change this sum proportion (of 21%) as necessary. Other methods, for example the use of carbon dioxide absorbent lime, can be used to actively and selectively remove gases from the cargo space of a container. However, such methods have disadvantages including the disposal of used lime and ineffective control.

An alternative approach is to provide a container having concentrations of oxygen and/or carbon dioxide that are different from that of ambient air and regularly measuring and actively maintaining those concentrations during a storage period. In particular, such systems will typically maintain low levels of oxygen and higher levels of carbon dioxide (compared to ambient air) so that the levels of respiration occurring within stored produce may be controlled. To effectively gauge the concentrations and/or volumes of oxygen and other gases within a container such a system may often utilize sensor technology which is located within a container and is adapted to actively assess the gaseous composition inside the container. These systems are commonly referred to as Controlled Atmosphere (CA) systems.

Such Controlled Atmosphere (CA) systems are adapted to ensure that the appropriate remedial action is taken to ensure that the gaseous composition of a container is maintained, or returned to an optimal level when deviation occurs. To ensure optimal levels of gases are maintained (usually this involves reduced oxygen levels and increased carbon dioxide levels) many Controlled Atmosphere (CA) systems are provided with a filter adapted to compress and separate the components of incoming air. In this way, as air is directed into a container, excess oxygen may be prevented from entering the container, which is desirable as it will ensure the retardation of respiratory activity within the container.

Use of Controlled Atmosphere (CA) systems will enable a container to maintain the optimal gas composition specifically suited to the produce and/or goods contained within where such a gas composition may be actively controlled throughout the period of storage.

Whilst such a system may effectively control and maintain optimal conditions that will contribute to longevity of stored produce such systems are extremely expensive to manufacture and maintain. Moreover, these systems tend to be complicated and typically demand the services of a skilled and specialized work force to ensure they are adequately maintained.

The provision of an improved control system which can actively monitor the composition of gases in a container and provide an optimal environment for the storage of container contents would be of advantage.

The provision of a system able to effectively control the flow of gases into and/or out of a container to thereby promote a gaseous atmosphere in a container which will prolong the shelf life of stored produce would be of advantage. The provision of such a system which is both relatively inexpensive to produce and maintain would be advantageous.

An apparatus for controlling the atmosphere in a container is disclosed in International Patent Application No. WO 2004/107868 disclosing a container including a plurality of walls and at least one inlet and/or outlet. Within the container is an apparatus including a sensor, a controller and a gas permeable membrane being adapted to facilitate the passage there through of different gases at different rates. The membrane separates the container into a first region and a second region, the first region being for holding cargo, and the second region defining a gas buffer region, where at least one inlet and/or outlet communicate(s) with the buffer region.

A problem to be solved is to achieve a controlled atmosphere in the cargo region of a container, wherein a membrane is able to obtain and hold low concentrations of carbon dioxide and of oxygen in the atmosphere in the cargo region. It may be disadvantageous if it is necessary to design a specific membrane to use with each kind of perishable goods, such as fruit and/or vegetables.

BRIEF SUMMARY

The disclosed embodiments relate to a container having a plurality of walls, and at least one inlet and/or outlet, the container including an apparatus for controlling the composition of gases within the container, the apparatus including at least one sensor, at least one controller and at least one gas permeable membrane, through which membrane different gases can pass at different rates, the membrane dividing the container into a first region being for holding cargo and a second region defining a gas buffer region, and the membrane being permeable permitting for nitrogen, oxygen and carbon dioxide at different flow rates The disclosed embodiments further relate to a method for controlling the composition of gases within a container, said method comprising providing the container with an apparatus including at least one inlet and/or outlet, at least one sensor, at least one controller and at least one gas permeable membrane through which membrane different gases can pass at different rates, said container comprising a first region for holding cargo, and said apparatus and membrane defining a second buffer region, said at least one inlet and/or outlet being in communication with said buffer region and said membrane being permeable permitting for nitrogen, oxygen and carbon dioxide at different flow rates.

Yet other disclosed embodiments relate to a container including a plurality of walls and at least one inlet and/or outlet. Within the container is an apparatus for controlling the composition of gases within the container. The apparatus includes a sensor, a controller and a gas permeable membrane being adapted to facilitate the passage there through of different gases at different rates. The membrane separates the container into a first region and a second region, the first region being for holding cargo, and the second region defining a gas buffer region, where at least one outlet able to establish communication between the buffer region and ambient atmosphere through one or more vacuum pump(s). The selectivity of the membrane may more or less be controlled by one or more vacuum pump(s), making it possible to use a wider range of membranes.

Other disclosed embodiments relate to an apparatus for controlling the composition of gases within a container, said container including a plurality of walls, said apparatus having at least one inlet and/or outlet, the apparatus including at least one sensor, at least one controller and at least one gas permeable membrane through which membrane different gases can pass at different rates, said container comprising a first region for holding cargo and apparatus and membrane defining a second gas buffer region, wherein the at least one outlet being capable of establishing communication between said buffer region and ambient atmosphere through one or more vacuum pump(s).

The disclosed embodiments also relate to a method for controlling the composition of gases within a container, said method comprising providing the container with an apparatus including at least one inlet and/or outlet, at least one sensor, at least one controller and at least one gas permeable membrane through which membrane different gases can pass at different rates, said container comprising a first region for holding cargo, and said apparatus and membrane defining a second buffer region, said at least one outlet being in communication with said buffer region and ambient atmosphere through one or more vacuum pump(s).

One aim of the disclosed embodiments is to provide a controlled atmosphere within a container by a simple system where the membrane is not the critical object to obtain a relatively high $CO_2$ concentration from the cargo region into the buffer region and out to the ambient atmosphere.

To that end, it is convenient if only a single membrane is used for a wide range of perishable goods, which membrane is capable of handling gas concentrations in the cargo region from as close to 0% carbon dioxide as possible to approximately 21% carbon dioxide and from of approximately 21% oxygen to as close to 0% oxygen as possible.

It is an object of the disclosed embodiments to address at least some of the problems in the related art or at least to provide the public with a useful choice. It is also an object of the disclosed embodiments to control the atmosphere within a container in a sufficient and stable way. Most of the parameters necessary for regulating $CO_2$ flux and $O_2$ flux are reduced by use of the teachings of the disclosed embodiments.

Furthermore, a container may provide an environment suitable for the growth of spoilage microorganisms and the proliferation of insects and other pests. To counter such activity systems normally rely on the use of chemicals to eliminate pathogen and insect damage to stored produce. The use of atmosphere control systems adapted to control respiration may also inhibit pathogen production and kill insects, and therefore contribute to a reduction in the number and quantity of chemicals, being applied to reduce or eliminate such damage to stored produce. For example, trials have demonstrated that the greatest impact on insect proliferation within a container may be achieved by maintaining reduced levels of oxygen for extended periods of time, which leads to oxygen deprivation in insect body tissue.

Other systems, methods, features and advantages will be, or will become, apparent to one with skill in the art upon examination of the following figures and detailed description. All such additional systems, methods, features and advantages are included within this description, are within the scope of the claimed subject matter, and are protected by the following claims.

BRIEF DESCRIPTION OF THE DRAWINGS

The system may be better understood with reference to the following drawings and description. The elements in the figures are not necessarily to scale, emphasis instead being placed upon illustrating the principles of the system. In the figures, like-referenced numerals designate corresponding parts throughout the different views.

DETAILED DESCRIPTION

Figure 1:
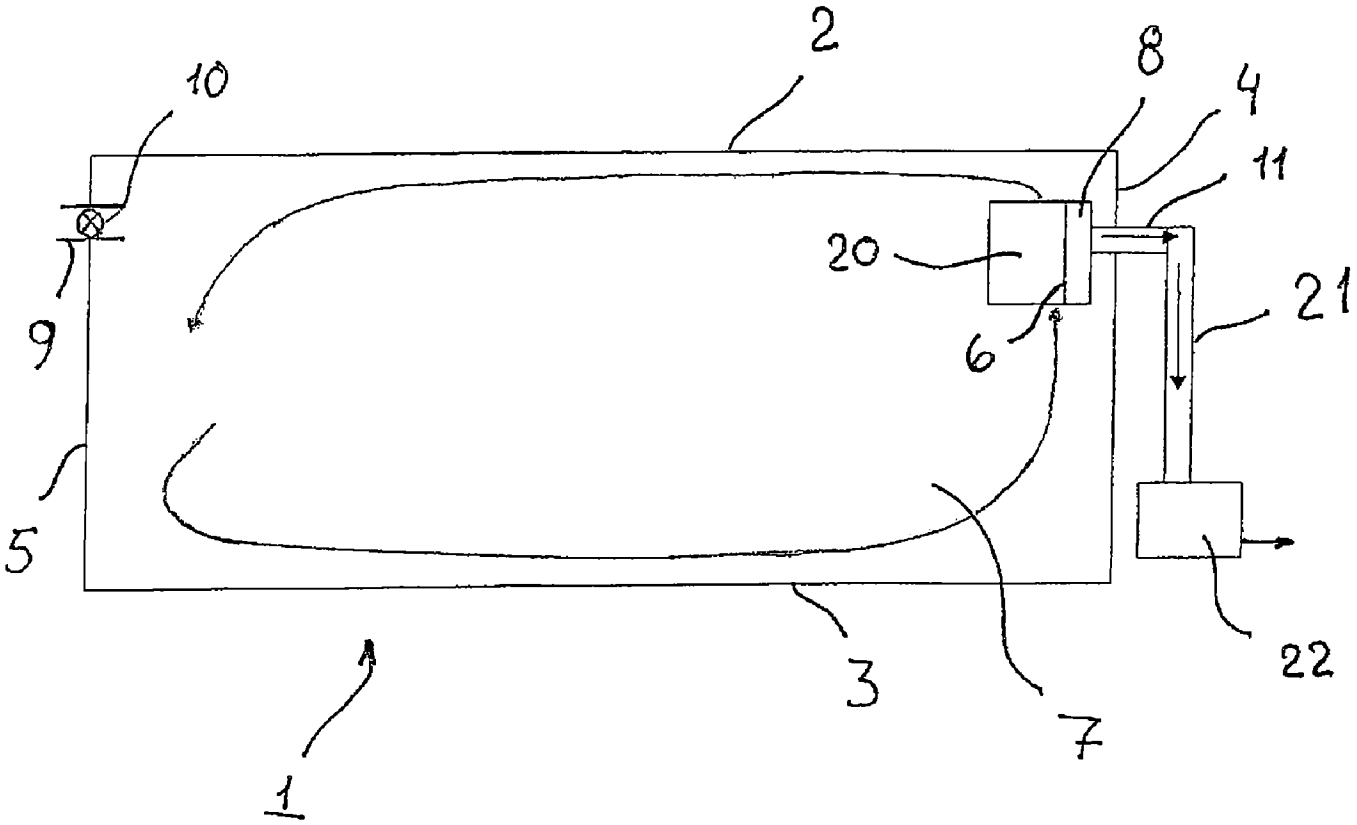
FIG. 1 schematically shows an embodiment of a container equipped with one or more vacuum pump(s).

The disclosed embodiments relate to a container having a plurality of walls, and at least one inlet and/or outlet, said container including an apparatus for controlling the composition of gases within the container, the apparatus including at least one sensor, at least one controller and at least one gas permeable membrane, through which membrane different gases can pass at different rates, said membrane dividing the container into a first region being for holding cargo and a second region defining a gas buffer region, and said membrane being permeable permitting for oxygen and carbon dioxide at different flow rates, wherein the buffer region is in communication with the ambient atmosphere through one or more vacuum pump(s)

During normal aerobic respiration quantities of oxygen will be consumed and replaced by carbon dioxide (and increased levels of water vapour). In a closed environment, such as a container, the shelf life of perishable goods have been shown to be negatively affected, that is, fruit and vegetables stored in oxygen deficient environments for prolonged periods of time will deteriorate and/or rot. Such a phenomenon is considered to be the result of the onset of anaerobic respiration, the by-products of which are more carbon dioxide and also alcohols and acetaldehydes. These by-products may quickly accumulate to toxic levels causing browning and death of fruit and vegetable tissue. Accordingly, to prolong the shelf life of stored goods it is considered necessary to ensure the availability of optimal concentrations and/or volumes of oxygen within the container.

As the levels of oxygen fall within the container the controller may be adapted to send an instruction to activate a valve (associated with bi-directional flow means, and inlet, or an outlet) to enable fresh air to flow into the container via an inlet. Conversely, as the fresh air is flowing into the container volumes of carbon dioxide may be evacuated from the container through one or more vacuum pump(s) via the buffer region.

In one embodiment the buffer region is formed as a kind of cartridge. The cartridge may be changeable and can be placed inside the container or outside the container with the membrane exposed to the atmosphere in the cargo region.

However, at optimal levels the concentration of carbon dioxide may serve as an inhibitor to respiratory activity of perishables. Furthermore, an optimal composition of carbon dioxide within a container, in combination with an optimal oxygen composition, may cause the perishables stored to exist in a near dormant state the consequence of which is natural ripening and allows crops to be harvested closer to ripeness or to be exposed to extended transportation periods.

The content of carbon dioxide typically increases within the cargo region of the container (due to normal respiration of produce stored). Such carbon dioxide may therefore be adapted to flow through the permeable membrane from the cargo storage compartment into the gas buffer region, thereby reducing the volume of carbon dioxide within the cargo region.

It is an object of the disclosed embodiments to provide a sufficiently high flux of carbon dioxide through the membrane to match the "production" of carbon dioxide from the high respiration rate of a commodity when the process is started. As the concentration of oxygen decreases in the cargo region and the respiration rate decreases as well as a consequence hereof, it is the aim of the disclosed embodiments to provide a buffer region capable of removing an amount of carbon dioxide corresponding to the "production" of carbon dioxide within the cargo region.

Normally the flow of carbon dioxide from the cargo region to the gas buffer region of a container will continue as long as the partial pressure of carbon dioxide within the cargo region remains higher than that of the gas buffer region. Once the partial pressure of carbon dioxide within the cargo region equals that within the gas buffer region equilibrium will be reached—that is, the flow of carbon dioxide through the permeable membrane will cease. When the buffer region is provided with communication with the ambient atmosphere through one or more vacuum pump(s) it is possible to continue removing carbon dioxide from the cargo region.

To achieve a membrane with sufficient surface area and with suitable physical dimensions, an embodiment of the membrane can be folded or pleated to achieve a surface area greater than the actual physical extension. Another possibility is to position a number of membranes in parallel or in a stack or battery. Hereby it is possible to maintain a great flow of volume (or flux) through the membrane at a relative small physical extension. The flow of volume through the membrane is directly proportional with the area of the membrane.

Another embodiment relates to an apparatus for controlling the composition of gases within a container, said container including a plurality of walls, said apparatus having at least one inlet and/or outlet, the apparatus including at least one sensor, at least one controller and at least one gas permeable membrane through which membrane different gases can pass at different rates, said container comprising a first region for holding cargo and apparatus and membrane defining a second gas buffer region, said at least one outlet able to establish communication between said buffer region and ambient atmosphere through one or more vacuum pump(s).

Preferably the gas permeable membrane may be adapted to facilitate the flow of carbon dioxide from the cargo compartment of the container to the gas buffer region of the container. As discussed above, normal aerobic respiration requires the availability of oxygen and produces carbon dioxide as a waste product. The effective disposal of this waste product is essential as above specific threshold levels, high carbon dioxide concentrations in a container combined with low levels of oxygen may result metabolic imbalances in perishables that result in internal damage of the goods.

In accordance with an exemplary embodiment, an apparatus is adapted to be used in a container where such an apparatus preferably is adapted to control the composition of gases within a container. Reference throughout this specification will be made to the present embodiments being used to control the composition of gases within containers, but those skilled in the art should appreciate that other applications are also envisioned for the present embodiments.

A third embodiment relates to a method for controlling the composition of gases within a container, said method comprising providing the container with an apparatus including at least one inlet and/or outlet, at least one sensor, at least one controller and at least one gas permeable membrane through which membrane different gases can pass at different rates, said container comprising a first region for holding cargo, and said apparatus and membrane defining a second buffer region, said at least one inlet and/or outlet being in communication with said buffer region and said membrane being permeable permitting for oxygen and carbon dioxide at different flow rates, said method comprising establishing, by one or more vacuum pump(s), a sub-atmospheric pressure in the buffer region sucking off gas from the first region of the container through the membrane.

This embodiment of a method according to the invention preferably has at least one of the following characteristics: (i) measuring the content of carbon dioxide in the buffer region and, if necessary, sucking off gas in the buffer region and the cargo region through the membrane by establishing a sub-atmospheric pressure in the buffer region; (ii) measuring the content of carbon dioxide in the cargo region and, if necessary, sucking off gas in the buffer region and the cargo region through the membrane by establishing a sub-atmospheric pressure in the buffer region; (iii) measuring the content of oxygen in the buffer region and, if necessary, sucking off gas in the buffer region and the cargo region through the membrane by establishing a sub-atmospheric pressure in the buffer region; (iv) measuring the content of oxygen in the cargo region and, if necessary, sucking off gas in the buffer region and the cargo region through the membrane by establishing a sub-atmospheric pressure in the buffer region.

The method further makes it possible to regulate and/or control the composition of gases in the enclosure by mixing the gas composition in the cargo region with air from the atmosphere is done by opening one or more valves to the ambient atmosphere.

Further it is possible to regulate and/or control the composition of gases in the enclosure by mixing the gas composition in the cargo region with a gas or a mixture of gases from a supply source. The gas or mixture of gases can be used to flush the cargo region after the perishables are positioned in the cargo region or a gas or a mixture of gases can be used to adjust the momentary gas composition within the cargo region.

In another embodiment of the method, the regulation of the composition of gases in the first region is effected by mixing the gas in the cargo region with air from the atmosphere by opening one or more valves to the ambient atmosphere. In yet another embodiment of the method, the regulation of the composition of gases in the first region is effected by mixing the gas composition in the cargo region with a gas or a mixture of gases from a source having a different composition of gases. Such a source may be in the form of a pressurized cylinder comprising gas of the desired composition, for example.

In other embodiments, the first region and the second region are divided or separated by the membrane. Preferably at least one container wall is adapted to locate said membrane.

A flow means may be represented by means provided to lead or transport a gas or a mixture of gases, such as pipes, tubes, ducts, hoses, canals, leading or transporting gas or mixture of gases (or ambient air) from one enclosure to another and/or from/to an enclosure to/from the ambient atmosphere.

In other embodiments, only one membrane is included, but more than one membrane of the substantially same type may be used to increase the total membrane area. A membrane may be preferably located by at least one wall of a container and may be adapted to affix to the interior of a container so as to divide said container into at least two sections. For example, a membrane affixed to the side walls, the roof and the floor of a container may effectively divide the container into two compartments, a first compartment being located substantially near the front of the container, and a second compartment being located substantially near the rear or door end of the container.

In a further embodiment, the membrane may be located substantially near the rear of the container. In such an embodiment the gas buffer region may therefore be located near the rear of the container. Furthermore, such a membrane may be located to provide a void or buffering region around at least one flow means which is adapted to control the flow of gases out of the buffer region and completely out of the container. Further the buffering region is provided with one or more vacuum pump(s), the one or more pump(s) having one or more outlets letting waste gas out into the ambient atmosphere.

However, in alternative embodiments the gas permeable membrane may be located or positioned in any number of orientations with respect to the container and need not be located substantially near the rear of the container so as to divide the container into two compartments. For example, the gas permeable membrane may be shaped as a bag or box. By shaping the gas permeable membrane as a bag or box, the buffer region may be made as an independent or replaceable unit, which may be located on either the exterior or the interior of a container. The bag or box may even be located on the exterior side as well as the interior side of a container. In alternative embodiments a container may include two, three or more membranes which may be positioned to divide the container into three, four or more regions. In addition, a membrane adapted for use with the present invention may be formed from any number or varieties of materials which exhibit gas or fluid permeable and/or selectively permeable characteristics. Those skilled in the art should appreciate that other locations for a permeable membrane and quantities and characteristics of a membrane are also envisioned and reference to the above only throughout this specification should in no way be seen as limiting.

In further exemplary embodiments a sensor located within the container may be adapted to sense the concentrations and/or volumes of carbon dioxide within the cargo storage compartment of a container. A sensor may be appropriately positioned to measure the concentrations of carbon dioxide within the various regions of a container. In particular, a sensor may be able to detect or sense when carbon dioxide levels within the cargo region are at a level indicative of respiratory activity having taken place within the container. In such instances the sensor may send a signal (such as a digital or analogue signal, or a voltage or amplitude value) to the controller which is adapted to activate or deactivate the one or more vacuum pump(s) located in the gas buffer region. These one or more vacuum pump(s) may open, thereby evacuating the carbon dioxide from that region and allowing carbon dioxide to continue to flow through the membrane.

Accordingly, and in a further embodiment the controller may activate or deactivate a valve controlling a bi-directional flow means to open an inlet so that air may flow into the cargo region of the container. As the oxygen concentration within the container diminishes (as a result of normal aerobic respiration) or as the pressure operating within the cargo region diminishes an inlet located within the cargo compartment of the container may be opened to supply a quantity of fresh air into the container. The operation of such an inlet may be controlled by the controller which receives signals from a sensor adapted to sense the oxygen and/or carbon dioxide composition within a container.

Accordingly, by appropriately opening and closing container inlet(s) and outlet(s) the composition of gases within the container may be controlled. Such operation may be enabled using a controller and may be facilitated by a number of sensors which are adapted to detect the composition of gases within a container.

In addition, the provision of a permeable membrane adapted to affix to the interior of the container enables evacuation of carbon dioxide from the cargo region of the container into a gas buffer region. The gas buffer region can similarly be evacuated by operation of one or more vacuum pump(s) removing carbon monoxide and/or carbon dioxide from the buffer region.

The term "respiring products" is used in the context of the present invention to designate fresh fruit or vegetables and other respiring biological materials such as apples, bananas, broccoli, cauliflower, mushrooms, asparagus and lettuce.

It is acknowledged that the term "comprise" may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

FIG. 1 shows a container 1 that has elements of an apparatus installed as configured in accordance with an exemplary embodiment of the present invention. The container 1 includes a roof 2, floor 3, two side walls (not shown), rear wall 4 (formed as a door) and a front wall 5. In a simple form (not shown), the invention can comprise a membrane 6 which is formed as a gas permeable plastic film. The membrane 6 is adapted to affix to the side walls, roof 2 and floor 3 of the container 1 to divide the container 1 into a storage region 7 and gas buffer region 8. Membrane 6 is configured to have greater permeability to carbon dioxide than to other gases that exist within container 1 (for example, oxygen, nitrogen, ethylene). Also shown is bi-directional flow means 9 which includes valve 10. Bi-directional flow means 9 is adapted to open to facilitate gas flows into or out of the container air into the cargo region 7 of the container.

In the embodiment shown, as the composition of carbon dioxide within the storage area 7 rises (for example, as a result of normal respiration), volumes of the carbon dioxide produced are conveyed via the membrane 6 to gas buffer region 8. Membrane 6 operates as a selectively permeable membrane having a greater permeability to carbon dioxide than to other gases prevailing in the container 1.

Cargo storage region 7 also preferably includes a sensor (not shown) which is adapted to poll the interior of the container to assess the composition of gases within the container. As the volume of oxygen decreases (as a result of normal aerobic respiration) within storage region 7 the sensor (not shown) will detect this occurrence and send an appropriate signal to a controller (not shown) which will activate or deactivate valve 10 to open flow means 9. By opening inlet 9 air will be supplied into the storage area 7, thereby increasing the oxygen content of same.

The composition of carbon dioxide typically increases within the storage region 7 of the container 1 due to normal respiration of perishables stored in the container. Such carbon dioxide will flow through the permeable membrane 6 into the gas buffer region 8, thereby reducing the volume and/or concentrations of carbon dioxide within the storage region 7.

Sensors appropriately located in the container are able to detect or sense when carbon dioxide levels within cargo region 7 and/or the gas buffer region 8 are at allowable levels. When the levels of carbon dioxide within the cargo region 7 and/or gas buffer region 8 become too high, a sensor will send a signal to the controller to activate or deactivate valve 12 (associated with bi-directional flow means 11) to open or to activate or deactivate one or more vacuum pump(s) which will facilitate the ingress of fresh air into the gas buffer region 8 as necessary and the evacuation of carbon dioxide from same. As the concentration of carbon dioxide within the buffer region 8 falls be-low the concentration of carbon dioxide within the storage region 7 the flow of carbon dioxide from the storage region 7 through the permeable membrane 6 into the buffer region 8 will proceed, thereby reducing the composition of carbon dioxide within the storage region 7.

Therefore, use of the system in a container 1 will effectively manipulate the composition of gases within the container 1 such that the sum proportion of carbon dioxide and oxygen in the container may be varied from 21%. In particular the outgoing and/or ingoing air may be actively manipulated through the opening and/or closing of inlets and outlets which effectively control gas flows into and/or out of container 1 which facilitates the change in this sum proportion (of 21%) as necessary.

The system including the apparatus makes it possible to use a method for controlling the composition of gases within a container 1, said container 1 including a plurality of walls, and at least one outlet 11, with an apparatus including at least one sensor, at least one controller and at least one gas permeable membrane 6 through which different parts of gases at different rates can pass, a first region 7 and a second region 8, the first region 7 being for holding cargo and the second 8 region defining a gas buffer region, said at least one outlet 11 being in communication with said buffer region 8, the method comprising removing carbon dioxide from the first region 7 by use of a membrane 6, one or more vacuum pump(s).

In a further embodiment of the method the first region 7 and the second region 8 is divided or separated by the membrane 6. The method further makes it possible to regulate and/or control the composition of gases in the enclosure by mixing the gas composition in the cargo region 7 with air from the atmosphere. The mixing may be done by opening one or more valves to the ambient atmosphere. Further it is possible to regulate and/or control the composition of gases in the enclosure by mixing the gas composition in the cargo region with a gas or a mixture of gases from a supply source. In effect, the above system provides an improved control method which can actively monitor the composition of gases in container 1 and provide an environment which can be optimized for the storage of container content.

Instead of having the membrane 6 adapted to affix to the side walls, roof and floor of the container as described above, the apparatus can be a replaceable unit comprising a buffer region 8 which includes a permeable membrane 6 either situated outside the container or inside the container. Furthermore, the system is able to effectively control the flow of gases into and/or out of a container to thereby promote a gaseous atmosphere in a container which will prolong the shelf life of stored produce—wherein the system provided is both relatively inexpensive to produce and to maintain. Control of the flow of gases keeps the optimal concentrations of oxygen and carbon dioxide for the specific commodity transported. The disclosed embodiments improve keeping the quality of the vegetables and fruits and reduce the losses during sea-borne carriage of fresh fruit and vegetables.

FIG. 1 further shows an embodiment of a container 1 equipped with a unit 20 comprising a buffer region and a permeable membrane 6 situated inside the container, the outlet of the buffer region being connected via a pipe 21 to one or more vacuum pump(s) 22.

Figure 2:
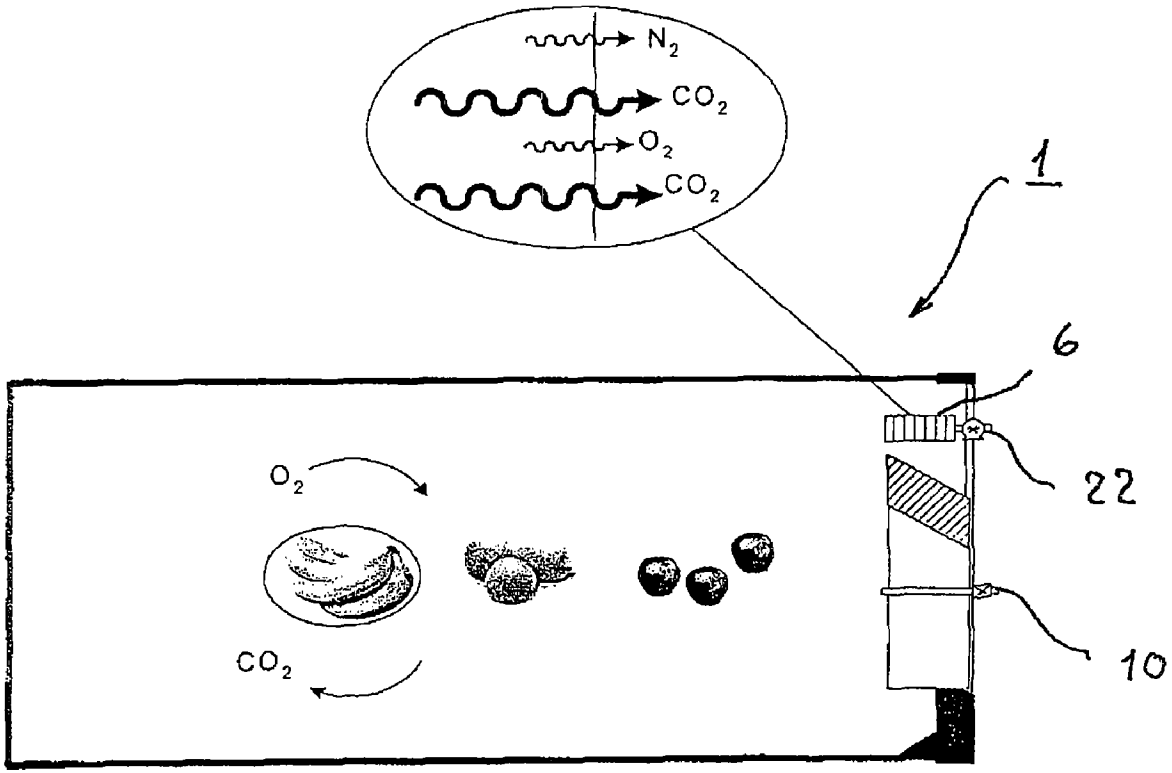
FIG. 2 shows an exemplary embodiment of a container with a buffer region/zone located inside the container and that is equipped with one or more vacuum pump(s).

FIG. 2 shows an embodiment of a container according to the invention equipped with a unit 20 comprising a buffer region and a permeable membrane situated inside the container, the outlet of the buffer region being connected to one or more vacuum pump(s) 22. When sucking off gas using the vacuum pump, gas is removed from the inside of the container and replaced by ambient atmospheric air entering through natural gaps or slots in the container, e.g. around the doors thereof or through a valve 10. Within the circle is indicated the flow of the different gases across the membrane when applying a vacuum.

One or more vacuum pump(s) may be placed inside the container, outside the container or attached directly to the wall of the container. Normally the cargo region will have an inside pressure corresponding to the pressure in the ambient atmosphere (1000 mbar). In an exemplary embodiment, the one or more vacuum pump(s) are capable of producing a sub-atmospheric pressure of below 200 mbar.

In another embodiment one or more vacuum pump(s) are capable of lowering the pressure to between 40 and 80 mbar and preferably between 50 and 75 mbar. By lowering the pressure a total difference in pressure is obtained, which permits a significant higher concentration of carbon dioxide (for example 5% carbon dioxide and 3% oxygen in the cargo region) resulting in more than 28% carbon dioxide and more than 4.5% oxygen in the waste gas.

In general different types of vacuum pumps may be used, but a very suitable type of vacuum pump is an oil-lubricated lamellae vacuum pump. Such a pump is capable of delivering the requested performances.

When using a vacuum pump a lot of vapour may leave the cargo region through the membrane and the vacuum pump to the outside atmosphere. When the waste gas rich in vapour leaves the vacuum pump or pumps, the waste gas may expand from below 200 mbar to 1000 mbar and will therefore condense in the outlet.

Further cooling containers often work in temperatures going from −30° C. to 50° C. When starting the vacuum pump or pumps at low temperatures the oil inside the pump body can be rather cold causing a severe lubrication to the moveable pump parts. The heat produced from the pump itself during cold ambient operation temperature is not sufficient to reach a temperature in the pump which is above the condensation temperature of the permeate gas (waste gas). Therefore a pre-heating unit may be provided within the oil tank of the pump(s). The pre-heating unit preheats the oil to an operating temperature which added with the temperature produced by the pump itself reaches a temperature above the condensation temperature of the permeate gas (waste gas).

The pump can be provided with means preventing the pump from being started if the oil temperature is too high. An example of such means can be a bimetallic contact, which is a simple and stable component.

Figure 3:
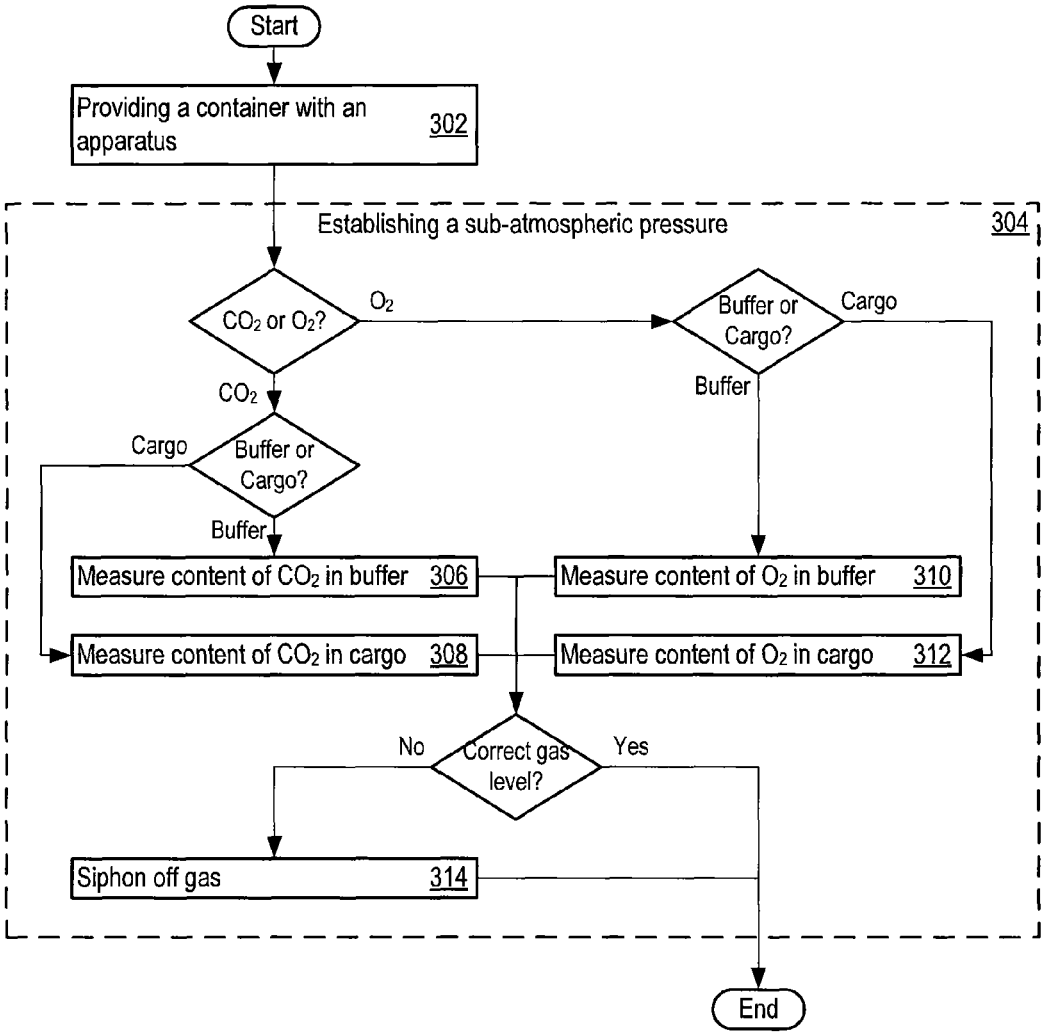
FIG. 3 shows an exemplary flow diagram for a method of controlling atmosphere within a container in accordance with another embodiment.

FIG. 3 shows an exemplary flow diagram 300 for controlling an atmosphere within a container. A system or operator provides a container with an apparatus (302). The apparatus may contain at least one inlet and/or outlet, at least one sensor, at least one controller and at least one gas permeable membrane. The membrane may permit different gases to pass through it at different flow rates. The membrane may be permeable for nitrogen, carbon dioxide and/or oxygen. The container may also contain a first region for holding cargo and a second region for buffering gas. The second buffer region may be defined by the apparatus and the membrane. The buffer region may be in communication with the inlet and/or outlet.

The system or operator establishes a sub-atmospheric pressure (304). The sub-atmospheric pressure may be established in the buffer region and may be established by one or more vacuum pumps. The sub-atmospheric pressure may be established by sucking off gas from the first region of the container through the membrane.

The establishment of a sub-atmospheric pressure may be characterized by measuring the content of carbon dioxide in the buffer region (306) and if necessary sucking off gas in the buffer region and the cargo region through the membrane by establishing a sub-atmospheric pressure in the buffer region (314). Alternatively, the establishment of a sub-atmospheric pressure may be characterized by measuring the content of carbon dioxide in the cargo region (308) and if necessary sucking off gas in the buffer region and the cargo region through the membrane by establishing a sub-atmospheric pressure in the buffer region (314). In other embodiments, the establishment of a sub-atmospheric pressure may be characterized by measuring the content of oxygen in the buffer region (310) and if necessary sucking off gas in the buffer region and the cargo region through the membrane by establishing a sub-atmospheric pressure in the buffer region (314). Also, the establishment of a sub-atmospheric pressure may be characterized by measuring the content of oxygen in the cargo region (312) and if necessary sucking off gas in the buffer region and the cargo region through the membrane by establishing a sub-atmospheric pressure in the buffer region (314).

While various embodiments of the container with a controlled atmosphere have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A container comprising:

a plurality of walls; and at least one inlet and/or outlet; and an apparatus for controlling the composition of gases within the container, the apparatus including:

at least one sensor configured to determine a gas composition;

at least one controller; and at least one gas permeable membrane, through which membrane different gases pass at different rates, said membrane dividing the container into a first region being for holding cargo and a second region defining a gas buffer region, and said membrane being permeable permitting for nitrogen, oxygen and carbon dioxide at different flow rates, wherein the gas buffer region is in communication with an ambient atmosphere through one or more vacuum pumps, wherein the at least one controller is configured to activate and deactivate the one or more vacuum pumps in response to a sensed composition of gas within the first region, and wherein the one or more vacuum pumps are activated to lower a concentration of carbon dioxide and oxygen within the container to below 21%.

2. A container according to claim 1, wherein the one or more vacuum pump(s) are oil-lubricated lamellae pump(s).

3. A container according to claim 1, wherein the one or more vacuum pump(s) are provided with a pre-heating element for preheating the lubrication oil for the pump(s).

4. An apparatus for controlling the composition of gases within a container, said container including a plurality of walls, said apparatus comprising:

at least one inlet and/or outlet;

at least one sensor configured to determine a gas composition;

at least one controller; and at least one gas permeable membrane through which membrane different gases pass at different rates, wherein said container comprises a first region for holding cargo and the apparatus and the at least one gas permeable membrane define a second gas buffer region, wherein the at least one inlet and/or outlet being capable of establishing communication between said second gas buffer region and an ambient atmosphere through one or more vacuum pumps, wherein the at least one controller is configured to activate and deactivate the one or more vacuum pumps in response to a sensed composition of gas within the first region, and wherein the one or more vacuum pumps are operated to lower a concentration of carbon dioxide and oxygen within the container to below 21%.

5. An apparatus according to claim 4, wherein the one or more vacuum pump(s) are oil lubricated lamellae pump(s).

6. An apparatus according to claim 4, wherein the one or more vacuum pump(s) are provided with a pre-heating element for preheating the lubrication oil for the pump(s).

7. A method for controlling the composition of gases within a container, said method comprising:

providing a container with an apparatus that includes:

at least one inlet and/or outlet;

at least one sensor configured to determine a gas composition;

at least one controller; and at least one gas permeable membrane through which membrane different gases can pass at different rates, said container comprising a first region for holding cargo, and said apparatus and membrane defining a second buffer region, said at least one inlet and/or outlet being in communication with said buffer region and said membrane being permeable permitting for nitrogen, oxygen and carbon dioxide at different flow rates;

one or more vacuum pumps configured to establish a sub-atmospheric pressure in the buffer region by evacuating gas from the first region of the container through the membrane, wherein the at least one controller is configured to activate and deactivate the one or more vacuum pumps in response to a sensed composition of gas within the first region; and operating the one or more vacuum pumps to lower a concentration of carbon dioxide and oxygen within the container to below 21%.

8. A method according to claim 7, wherein establishing a sub-atmospheric pressure comprises measuring the content of carbon dioxide in the buffer region and if necessary sucking off gas in the buffer region and the cargo region through the membrane by establishing a sub-atmospheric pressure in the buffer region.

9. A method according to claim 7, wherein establishing a sub-atmospheric pressure comprises measuring the content of carbon dioxide in the cargo region and if necessary sucking off gas in the buffer region and the cargo region through the membrane by establishing a sub-atmospheric pressure in the buffer region.

10. A method according to claim 7, wherein establishing a sub-atmospheric pressure comprises measuring the content of oxygen in the buffer region and if necessary sucking off gas in the buffer region and the cargo region through the membrane by establishing a sub-atmospheric pressure in the buffer region.

11. A method according to claim 7, wherein establishing a sub-atmospheric pressure comprises measuring the content of oxygen in the cargo region and if necessary sucking off gas in the buffer region and the cargo region through the membrane by establishing a sub-atmospheric pressure in the buffer region.

12. The container according to claim 1, wherein an ambient pressure outside of the container is about 1000 mbar and the one or more vacuum pump is activated to lower a pressure within the container to below 200 mbar.

13. The container according to claim 12, wherein the one or more vacuum pump is activated to lower the pressure within the container to between about 40 and 80 mbar.

14. The container according to claim 13, wherein the one or more vacuum pump is deactivated when the concentration of carbon dioxide is about 5% and the concentration of oxygen is about 3%.

15. The apparatus according to claim 4, wherein an ambient pressure outside of the container is about 1000 mbar and the one or more vacuum pump is activated to lower a pressure within the container to below 200 mbar.

16. The apparatus according to claim 15, wherein the one or more vacuum pump is activated to lower the pressure within the container to between about 40 and 80 mbar.

17. The apparatus according to claim 16, wherein the one or more vacuum pump is deactivated when the concentration of carbon dioxide is about 5% and the concentration of oxygen is about 3%.

18. The method according to claim 7, wherein an ambient pressure outside of the container is about 1000 mbar and the one or more vacuum pump is activated to lower a pressure within the container to below 200 mbar.

19. The method according to claim 18, wherein the one or more vacuum pump is activated to lower the pressure within the container to between about 40 and 80 mbar.

20. The method according to claim 19, wherein the one or more vacuum pump is deactivated when the concentration of carbon dioxide is about 5% and the concentration of oxygen is about 3%.

* * * * *